US005881666A

United States Patent [19]

Crews, Jr.

[11] Patent Number: 5,881,666

[45] Date of Patent: Mar. 16, 1999

[54] WATERTIGHT TRIM TAB ACTUATOR

[76] Inventor: L. Jeremy Crews, Jr., 8790 Park Central Dr., Richmond, Va. 23227

[21] Appl. No.: 874,948

[22] Filed: Jun. 13, 1997

[51] Int. Cl.[6] ..... B63B 1/22

[52] U.S. Cl. ..... 114/285

[58] Field of Search ..... 114/284, 285, 114/286, 287; 440/59

[56] References Cited

U.S. PATENT DOCUMENTS

| | | | |
|---|---|---|---|
| 3,046,928 | 7/1962 | Sherrill . | |
| 3,177,837 | 4/1965 | Sherrill . | |
| 3,327,671 | 6/1967 | Comins | 114/285 |
| 3,379,158 | 4/1968 | Plum . | |
| 3,589,323 | 6/1971 | Kercheval . | |
| 3,628,487 | 12/1971 | Bennett . | |
| 4,232,626 | 11/1980 | Kern . | |
| 4,403,969 | 9/1983 | Pichl | 440/59 |
| 4,742,794 | 5/1988 | Hagstrom . | |
| 5,117,741 | 6/1992 | Pichards . | |
| 5,474,013 | 12/1995 | Wittmaier . | |
| 5,524,567 | 6/1996 | Astley et al. . | |

*Primary Examiner*—Stephen Avila
*Attorney, Agent, or Firm*—Miller, White, Zelano, & Branigan, P.C.

[57] ABSTRACT

The present application is directed to an improved trim tab actuator. A ram adapted to be connected at a first end to the trim tab and connected at a second end to the drive. The ram has a longitudinal portion equal to at least the maximum stroke of the ram and is received in the longitudinal bore of which longitudinal bore has a length equal to or greater than the maximum stroke of the ram. An inboard seal is disposed between the ram and bore, the inboard seal being positioned inboard of the longitudinal portion of the ram when the ram is retracted.

17 Claims, 2 Drawing Sheets

WATERTIGHT TRIM TAB ACTUATOR

FIELD OF THE INVENTION

The present invention relates to trim tab actuators. More particularly, the present invention relates to actuators for trim tabs used on boats.

BACKGROUND OF THE INVENTION

Many powerboats are equipped with trim tabs which extend from the rear of the hull and are pivotally attached at a point at the lower rear point of the hull. Trim tabs are well known in the industry for their value in controlling the trim of a boat in view of varying load distributions, speeds, water and wind conditions and other variables. The trim tabs and the associated actuators which move the tabs up and down in the water, typically remain underwater when the vessel is at rest.

The most common type of drive for a trim tab actuator is hydraulic, wherein a hydraulic pump is mounted inside the boat and connected to a hydraulic actuator which is, in turn, connected to the trim tab. Hydraulic pressure moves the trim tab down through the motion of the ram which moves in and out of a cylinder. Upon removal of hydraulic pressure, a spring returns the ram which raises the trim tab. This system is typically very effective when new, but may develop leakage problems after a relatively short time. Typically, the seal fails when the cylinder surface becomes covered with barnacles or other similar abrasive materials. These abrasive materials then scrape against the ram to cylinder seal resulting in leakage of hydraulic fluid out of the cylinder. This is undesirable since even small amounts of oil leaked may cause a sheen on the water and adversely affect the environment and constitute a violation of maritime environmental laws. Also, continued leaking of the system's hydraulic oil will render it inoperative if not constantly refilled.

Similarly, another type of trim tab actuator has a reversible electric motor and screw mechanism mounted within a housing which drives a ram in and out to cause the trim tab to move up and down as desired. If the ram is fouled, as described earlier, and the seal is damaged, water will leak into the housing and the motor and associated mechanism will fail, causing the tab to become useless.

A further contributing factor concerning water leakage into an electro-mechanical trim tab actuator is the fact that when the ram moves outward within the housing, a vacuum is created because it is a closed system experiencing an expanding volume. This vacuum can draw water into the housing, particularly if the seal is already damaged. Even water vapor that is drawn into the housing with each use as a result of the vacuum in the housing may have a corrosive effect on the mechanism in the housing.

SUMMARY OF THE INVENTION

It is an object of the present invention to have a trim tab actuator which remains watertight for an extended period.

Further objects, characteristics and advantages of the invention will become apparent from a study of the accompanying drawings and of the description of an exemplary preferred embodiment given below and of accompanying claims.

The present application is directed to a trim tab actuator which uses a drive for positioning a trim tab on a boat.

The actuator includes a ram adapted to be connected at a first end to the trim tab and connected at a second end to the drive. The ram has a longitudinal portion equal to a maximum stroke of the ram and is received in the longitudinal bore of which longitudinal bore has a length greater than the maximum stroke of the ram. An inboard seal is disposed between the ram and the bore, the inboard seal being positioned inboard of the longitudinal portion of the ram when the ram is retracted.

In a further aspect of the invention, a trim tab actuator adapted to position a trim tab on a boat has a ram having a first end and a second end, the first end adapted to be connected to the trim tab. A fluid-tight housing receives the ram, the housing having a first end and a second end, the first end being adapted to be connected to the boat and the second end having the first end of the ram projecting therefrom. An electric motor is within the housing and is connected to the second end of the ram for advancing the ram from the housing and retracting the ram into the housing. A vent connects the housing to the atmosphere.

In still a further aspect, a check valve is associated with the vent, the check valve being normally biased closed and oriented to open upon the ram extending from the housing.

In still a further aspect, the ram has a maximum stroke and the housing includes a bore having an end from which the ram projects with the bore including a seal positioned within the bore at a location spaced a distance from the end of the bore at least as great as the maximum stroke of the ram.

In still a further aspect, an electric power line extends from the housing into the boat containing the vent tube, coextensive with the power line and having an open end for venting the housing within the boat.

In still a more specific aspect, the invention is directed to an improved trim tab actuator designed to remain watertight even after frequent use in adverse conditions. The actuator comprises a watertight housing having a top end and a bottom end and a longitudinal length defined by the distance between the ends. A bracket is fixed to the top end of the housing for pivotally anchoring the housing to the boat. A ram is mounted substantially within the housing and extends from the bottom end of the housing and has a drive connected to it for causing longitudinal movement of the ram into and out of the bottom end of the housing. The drive moves the ram out of the housing for any desired length up to a predetermined maximum length. A first seal is mounted within the housing and is disposed about the ram. This first seal is located at the bottom end of the housing. A second seal is mounted within the housing and is disposed about the ram. The second seal is located along the longitudinal length of the housing at a distance from the bottom end of the housing at least as great as the predetermined maximum length of longitudinal movement of the ram. As a result of the foregoing, the outer surface of the ram that is exposed to the potentially harmful environment outside the housing never passes through the second seal mounted within the housing. Thus, the integrity of the second seal is never breached by fouling material that may attach to the surface of the ram when exposed outside of the housing.

Another feature of the invention that may be used alone or in conjunction with the protected second seal includes creating ambient or positive air pressure within the housing. This actuator includes a watertight housing having a top end and a bottom end and a bracket fixed to the top end for pivotally anchoring the housing to the boat. A ram is mounted substantially within the housing and extends from the bottom end of the housing and is connected to an electric motor mounted within the housing for causing longitudinal movement of the ram into and out of the bottom end of the housing. A vent tube connects the housing to outside air wherein the vent tube has a first end open to outside air and a second end open to the inside of the housing. In this way, air may flow into and out of the inside of the housing during the movement of the ram into and out of the housing. In order to create a positive air pressure within the housing, the second end of the vent tube may have a check valve for allowing air to flow into the inside of the housing but not out of the inside of the housing.

DETAILED DESCRIPTION OF A PREFERRED EMBODIMENT

Figure 1:
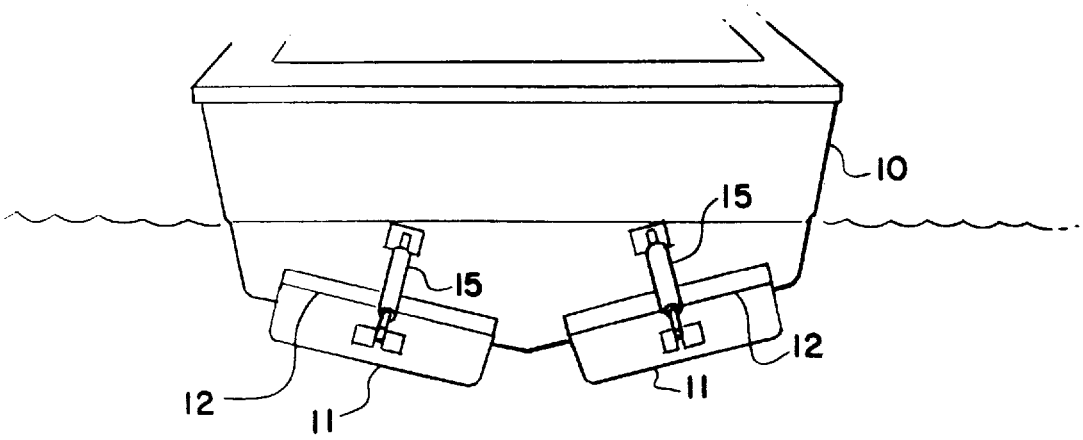
FIG. 1 is a perspective view of the rear of a boat having a pair of trim tabs and associated actuators.

Referring first to FIG. 1, a boat 10 is shown having a pair of trim tabs 11 mounted on its hull. The trim tabs 11 are pivotally attached at one end to the boat 10 by a hinge 12 or other flexible member. Spaced from the hinges 12, trim tab actuators 15 are attached to each trim tab. The other ends of each of the trim tab actuators 15 are further anchored to the rear of the boat 10. The actuators 15 are typically controlled by a person inside the boat. Using the actuators 15, the trim tabs 11 may be deployed downwardly so as to cause upward lift of the back end of the boat when the boat 10 is moving forward or the trim tabs may be pulled upwardly so that they are parallel to the water flow and offer little effect as the boat moves forward. Trim tabs 15 are known for their value in controlling the trim of a boat in view of varying load distributions, speeds, water and wind conditions and other variables. The trim tabs 15 may be moved downwardly and upwardly together or independently depending on the specific requirements or the preference of the person or persons in the boat. As is illustrated in FIG. 1, the trim tabs and the trim tabs actuators 15 are usually under water when the boat is at rest. When one of the actuators 15 is in its full down position and particularly if it is left in the down position for an extended period of time, a portion of the associated actuator 15 may foul as a result of barnacles or other abrasive materials that may attach to the actuator.

Figure 2:
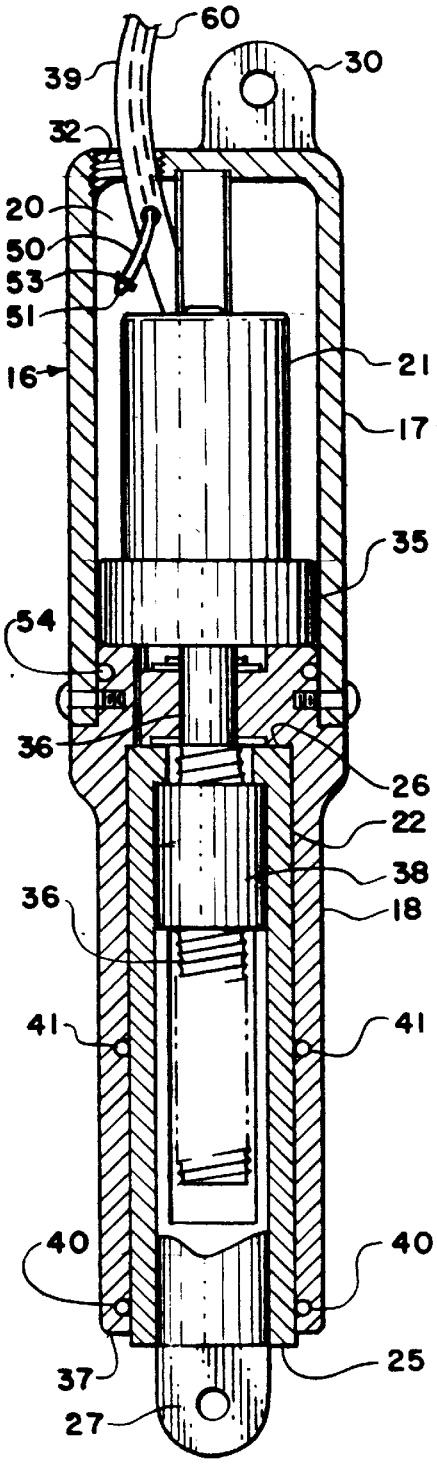
FIG. 2 is a front elevation, cross-sectional view of one of the actuators of FIG. 1 according to the claimed invention showing a ram of the actuator in a fully withdrawn position.
Figure 3:
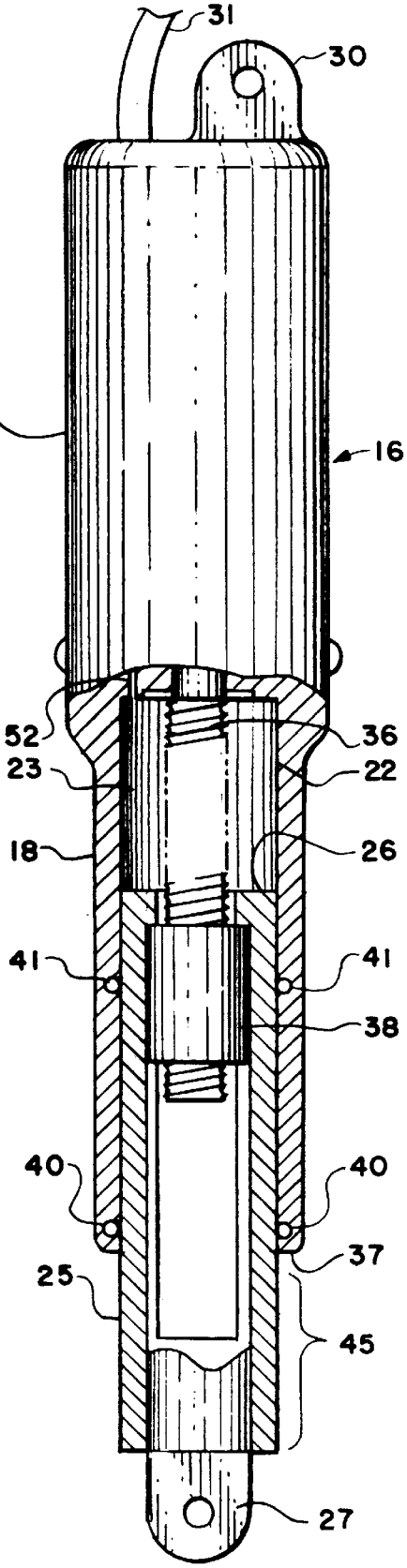
FIG. 3 is a front elevation, cross-sectional view of the actuator showing the ram extended to a predetermined maximum length.

FIGS. 2 and 3 depict a preferred embodiment of one of the actuators 15 comprising the claimed invention. The actuator 15 includes a housing 16 having a top piece 17 and a bottom piece 18. The housing 16 is typically made of a polymer or composite. The primary attribute of the material making up the housing must be that it is waterproof and will hold up well in different marine environments. The illustrated housing 16 is a two-piece housing. Other single or multi piece designs may be used. The top piece 17 of the housing is hollow. This hollow area defines an upper chamber 20 and contains within it the drive. In this case, the drive is an electric motor 21. The bottom piece 18 of the housing 16 is attached to the top piece 17 in a watertight fashion. The bottom piece 18 has a longitudinal bore 22 that defines a lower chamber 23 containing the ram 25 that is extended from and withdrawn into the bottom piece 18 of the housing 16.

Extending from the housing 16 is a bracket 30. The bracket 30 may be flexibly anchored to the hull of the boat 10. Many types of actuators 15 have a rotatable attachment to allow for the movement of the actuator when the trim tab is moved downwardly and upwardly. A pin connects the bracket 30 to an anchor (not shown) where the anchor is the hardware actually attached to the boat 10, the bracket rotatably attaching the actuator 15 to the anchor.

Inside the actuator 15 there is an electric motor 21. The motor 21 may be operated by a person inside the boat. The motor obtains power through the electric power line 31 that extends through a watertight bushing 32 of the housing 16 and into the boat 10. The motor is connected to a gear box 35. The gear box 35 is connected to a threaded shaft 36. The threaded shaft 36 is threaded and is connected to the first end 26 of a ram 25. The ram 25 is the cylindrical piece that is mounted substantially within the actuator 15 but extends from the bottom end 37 of the actuator. A first end 26 of the ram 25 is connected to the shaft 36 and second end 27 of the ram 25 is pivotally connected to a trim tab 11 (FIG. 1). The ram 25 is hollow allowing the threaded shaft 36 to insert into the hollow interior of the ram. The ram further includes a threaded ball screw 38 such that the ram may be longitudinally moved out of and back into the housing 12 by means of the tuning of the shaft 36 by the motor 21. This type of assembly where an electric motor 21 is connected to a shaft 36 and ball screw 38 device within a ram 25 for extending and withdrawing the ram out of and into the housing 16 is known conventionally to those of skill in the art. Other methods of mounting an electric motor and connecting it to a ram for extending it out of and withdrawing it back into the housing will also be known by those of skill in the art.

Other types of drives include hydraulic systems, different mechanical systems and pneumatic systems. In these and other systems, it is advantageous to incorporate features of the disclosed invention. Any time that a ram 25 moves a trim tab 11 up and down, such ram may be fouled by abrasive elements in the water resulting in damage to an associated seal.

The length of movement of the ram 25 out of and back into the housing 16 is also referred to as the stroke of the ram. The ram 25 moves in and out in the longitudinal direction. The longitudinal movement of the ram is limited by the construction of the assembly. The length of maximum longitudinal extension of the ram 25 is also referred to as the maximum stroke of the ram. In a preferred embodiment, the ram is fully extended when the ram is extended two and one-quarter inches (2¼") from its fully withdrawn position. In other words, the maximum stroke of the ram 25 is two and one-quarter inches (2¼").

At the bottom of the housing 16 there is a first seal 40 that keeps water from seeping into the inside of the housing. In the illustrated embodiment, the first seal 40 is an o-ring mounted substantially at the bottom end 37 of the housing. A second seal 41, in this case an o-ring, is also shown. This o-ring seal 41 is placed inboard of the first seal 40 at a predetermined distance up the longitudinal length of the housing 16 from the bottom of the housing. This length is identified based on the predetermined maximum stroke of the ram 25 and is at least as great as the predetermined maximum stroke. The second seal is placed two and one-quarter inches (2¼") from the first seal 40, a distance equal to or greater than the maximum stroke of the ram. In this way, the longitudinal portion 45 of the ram that was extended outside of the housing 16 when extended to its maximum length will never come in contact with the second seal 41. The longitudinal portion 45 of the ram exposed is specifically shown in FIG. 3, which shows the ram at its predetermined maximum length of extension. This is apparent from FIG. 3 when compared to FIG. 2 where the ram 25 is in its full withdrawn or retracted position inside the housing 16.

The second seal 41 is also referred to as an inboard seal because it is set inside the housing away from the bottom end 37 and inside the housing from the first seal. The inboard seal 41 is shown fixed to the longitudinal bore 22 that contains the ram 15.

Also shown in FIG. 2 is a vent tube 50. The vent tube 50 has a first end (not shown) open to the atmosphere and a second end 51 open to the inside of the housing 16 and specifically the upper chamber inside the housing. A second end 51 of the vent tube 50 has a check valve 53 that is normally biased closed but that is oriented to open for allowing air to flow into the inside of the housing but not out of the inside of the housing when the ram is retracting into the housing. Also shown is a vent passage 52 that connects the upper chamber 20 inside of the housing 16 to the lower chamber 23 inside the housing. This vent passage 52 allows air to flow to and from inside the upper chamber 20 of the housing 16 to the lower chamber 23 of the housing in which the ram 25 is received.

In practice, when the ram 25 is being extended from the housing 16, the increasing internal volume creates a negative pressure inside the housing 16. As can be seen in the figures, when the ram 25 is being extended from the housing 16, air can flow through the vent tube 50 into the housing 16 and further into the lower chamber 23 so that the pressure within the inside of the housing remains ambient. In the illustrated embodiment, the check valve 53 at the end of the vent tube 50 prevents the outward flow of air. Thus when the ram is extended and then withdrawn back into the housing 16, a positive air pressure is created inside the housing. This positive air pressure is a further deterrent to water seeping into the housing 16.

Another way to help keep abrasive materials from the surface of the ram 25 is to fix an elastic bellows (not shown) around the ram and the bottom end 37 of the housing 16. The elastic bellows has one end sealed around the bottom end 37 of the housing. The other end of the bellows is sealed around the circumference of the ram that protrudes from the housing. When the ram 25 is extended, the bellows covers the exposed length of the ram in the water. The bellows is typically made of rubber or some other flexible and watertight material.

As is shown, the vent tube 50 may be wrapped in a waterproof jacket 60 with the electric power line 31 that comes into the housing to power the electric motor. In this way, the vent tube 50 is coextensive with the power line 31 and there is only one cable that comes in and out of the actuator housing 16. The vent tube 50 extends from the jacketed cable on the inside of the housing as well as into the atmosphere from within the boat 10.

While the invention has been described with particular reference to a specific embodiment, in the interest of complete definiteness, it will be understood that it may be embodied in a variety of forms diverse from those specifically shown and described, without departing from the spirit and scope of the invention as defined by the appended claims.

That which is claimed is:

1. A trim tab actuator able to position a trim tab on a boat comprising:

a watertight housing having a top end and a bottom end and a longitudinal length defined by the distance between the ends;

a ram mounted substantially within the housing and extending from the bottom end of the housing;

a drive connected to the ram for causing longitudinal movement of the ram into and out of the bottom end of the housing for up to a predetermined maximum length;

a first seal mounted within the housing and disposed about the ram wherein the first seal is located at the bottom end of the housing;

a second seal mounted within the housing and disposed about the ram wherein the second seal is located at a longitudinal distance from the bottom end at least as great as the predetermined maximum length of longitudinal movement of the ram, whereby the section of the ram that is exposed outside of the housing during the ram movement into and out of the housing during use when positioning a trim tab never passes through the second seal within the housing.

2. The trim tab actuator of claim 1 wherein the drive is an electric motor mounted within the housing.

3. The trim tab actuator of claim 1 further comprising a vent tube connecting the housing to the atmosphere, wherein the vent tube has a first end open to the atmosphere and a second end open to the inside of the housing.

4. The trim tab actuator of claim 1 wherein elastic bellows has one end attached to the bottom of the housing and its other end attached to the ram in a watertight manner.

5. A trim tab actuator able to position a trim tab on a boat comprising:

a watertight housing having a top end and a bottom end;

a ram mounted substantially within the housing that extends from the bottom end of the housing;

an electric motor mounted within the housing and connected to the ram for causing longitudinal movement of the ram into and out of the bottom end of the housing;

a vent tube connecting the housing to the atmosphere, wherein the vent tube has a first end open to outside air and a second end open to the inside of the housing;

whereby air may flow into and out of the inside of the housing during the movement of the ram into and out of the housing during use when positioning a trim tab.

6. The trim tab actuator of claim 5 wherein the second end of the vent tube has a check valve for allowing air to move into the inside of the housing but not out of the inside of the housing.

7. The trim tab actuator of claim 5 comprising an electric power line that is connected to and powers the electric motor and that is further connected to a power source outside of the housing by passing through the housing in a watertight bushing wherein the vent tube is coextensive with the electric power line open to the inside of the housing and is open to outside air.

8. A trim tab actuator which uses a drive for positioning a trim tab on a boat, comprising:

a ram adapted to be connected at a first end to the trim tab and connected at a second end to the drive, the ram having a longitudinal portion equal to a maximum stroke of the ram;

a housing for receiving the ram in a longitudinal bore thereof, which longitudinal bore has a length at least the maximum stroke of the ram, the housing having a bottom end through which the first end of the ram projects; and an inboard seal between the ram and the bore, the inboard seal disposed inboard of the longitudinal portion of the ram when the ram is retracted.

9. The trim tab actuator of claim 8 including another seal disposed proximate the open end of the ram.

10. The trim tab actuator of claim 9, wherein the inboard seal is fixed in the bore.

11. The trim tab actuator of claim 8, wherein the inboard seal is fixed in the bore.

12. A trim tab actuator adapted to position a trim tab on a boat comprising:

a ram having a first end and a second end, the first end adapted to be connected to the trim tab;

a fluid-tight housing receiving the ram, the housing having a first end and a second end, the first end adapted to be connected to the boat and the second end having the first end of the ram projecting therefrom;

an electric motor within the housing and being connected to the second end of the ram for advancing the ram from the housing and retracting the ram into the housing; and a vent connecting the housing to the atmosphere.

13. The trim tab actuator of claim 12 further including a check valve associated with the vent, the check valve being a normally biased closed and oriented to open upon the ram extending from the housing.

14. The trim tab actuator of claim 12, wherein the ram has a maximum stroke and the housing includes a bore having an end from which the ram projects, the bore including a seal positioned within the bore at a location spaced a distance from the end of the bore at least as great as the maximum stroke of the ram.

15. The trim tab actuator of claim 14, wherein an electric power line extends from the housing into the boat and wherein the vent includes a tube coextensive with the power line and having an open end for venting the housing within the boat.

16. The trim tab actuator of claim 13, wherein an electric power line extends from the housing into the boat and wherein the vent includes a tube coextensive with the power line and having an open end for venting the housing within the boat.

17. The trim tab actuator of claim 12, wherein an electric power line extends from the housing into the boat and wherein the vent includes a tube coextensive with the power line and having an open end for venting the housing within the boat.

* * * * *